US005683139A

United States Patent [19]

Golynsky et al.

[11] Patent Number: 5,683,139

[45] Date of Patent: Nov. 4, 1997

[54] CHAIR SEAT TILT ADJUSTMENT AND LOCKING MECHANISM

[75] Inventors: Arkady Golynsky, Allentown; Donald A. Wimmer, Upper Hanover, both of Pa.

[73] Assignee: Knoll, Inc., East Greenville, Pa.

[21] Appl. No.: 744,562

[22] Filed: Nov. 6, 1996

Related U.S. Application Data

[60] Continuation of Ser. No. 520,626, Aug. 29, 1995, abandoned, which is a division of Ser. No. 182,816, Jan. 13, 1994, Pat. No. 5,464,274.

[51] Int. Cl.[6] ..... A47C 1/02

[52] U.S. Cl. ..... 297/302.3; 297/300.4; 297/302.7; 297/328; 16/386; 403/66; 403/161

[58] Field of Search ..... 297/300.4, 301.3, 297/302.3, 302.7, 303.3, 463.1, 463.2, 328; 16/2.1, 386; 403/66, 161

[56] References Cited

U.S. PATENT DOCUMENTS

| | | | |
|---|---|---|---|
| 1,746,986 | 2/1930 | Bell . | |
| 2,592,130 | 4/1952 | Erb et al. | 16/2 |
| 3,076,668 | 2/1963 | Famely | 16/2 |
| 3,522,970 | 8/1970 | Francis . | |
| 3,801,209 | 4/1974 | Matsuoka | 16/2 |
| 3,879,082 | 4/1975 | Gwin . | |
| 4,137,603 | 2/1979 | Kvasnes | 403/161 |
| 4,248,479 | 2/1981 | Toda . | |
| 4,364,602 | 12/1982 | Rigazio . | |
| 4,555,085 | 11/1985 | Bauer et al. . | |
| 4,629,249 | 12/1986 | Yamaguchi . | |
| 4,636,003 | 1/1987 | Siebler . | |
| 4,636,004 | 1/1987 | Neumuller . | |
| 4,720,142 | 1/1988 | Holdredge et al. . | |
| 4,752,101 | 6/1988 | Yurchenco et al. . | |
| 4,807,330 | 2/1989 | Gomes | 16/386 |
| 4,818,020 | 4/1989 | Meiller et al. . | |
| 4,832,402 | 5/1989 | Zund . | |
| 4,883,319 | 11/1989 | Scott | 16/2 |
| 4,890,886 | 1/1990 | Opsvik . | |
| 4,892,354 | 1/1990 | Estkowski et al. . | |
| 4,943,115 | 7/1990 | Stucki . | |
| 5,029,940 | 7/1991 | Golynsky et al. . | |
| 5,069,586 | 12/1991 | Casey | 16/2 |
| 5,370,445 | 12/1994 | Golynsky . | |
| 5,388,889 | 2/1995 | Golynsky . | |
| 5,417,474 | 5/1995 | Golynsky . | |

*Primary Examiner*—Peter M. Cuomo
*Assistant Examiner*—Anthony D. Barfield
*Attorney, Agent, or Firm*—Buchanan Ingersoll, P.C.

[57] ABSTRACT

A chair tilt control mechanism for a pedestal base chair having a chair control housing mounted on the pedestal chair base and pivotally supporting a chair seat support member. A laterally movable front stop member retained within the chair control housing is movable and contacts the front flange of the chair seat support member and limits the pivotal movement of the chair seat support member to predetermined angular positions with respect to the chair control housing and the floor supporting the chair. Also disclosed is a lever member adapted to lock the chair seat support member in one or more predetermined angular positions. Also disclosed is a hollow plastic pivot pin for pivotally connecting a chair control housing to a chair seat support member.

4 Claims, 5 Drawing Sheets

(ENLARGED)

CHAIR SEAT TILT ADJUSTMENT AND LOCKING MECHANISM

This application is a continuation of application Ser. No. 08/520,626, filed Aug. 29, 1995 now abandoned which is a Divisional application of Ser. No. 182,816 filed Jan. 13, 1994 now issued U.S. Pat. No. 5,464,274.

BACKGROUND OF THE INVENTION

This invention relates to a tilt adjustment and locking mechanism for a chair. It relates particularly to a user operated seat tilt adjustment and locking mechanism for a pedestal type of office chair.

Chair control mechanisms are mechanical devices, usually mounted beneath the seat of a chair, to control the height and the tilt or angle of the chair seat relative to the floor on which the chair rests. Most chair control mechanisms provide for the chair seat to be positioned parallel to or at a slightly backward tilt angle (about 4–5 degrees) with respect to the floor surface when in the "at rest" or neutral position. Some chair control mechanisms provide for additional backward lean or tilt of the chair seat from the "at rest" or neutral chair seat position as the user leans backward against the chair back.

In recent years, the widespread use of computer terminals in the office has prompted a need for an office chair seat control mechanism that would also allow the chair seat to be tilted several degrees slightly forward from the "at rest" or neutral chair seat position to provide more comfort to the user when working at a computer keyboard, a desk surface or other office equipment.

SUMMARY OF THE INVENTION

It is therefore an object of this invention to provide a chair control mechanism that allows the user to move the chair seat to a forward tilt position from a neutral or "at rest" chair seat position and to lock the chair seat in either the forward tilt or "at rest" position.

It is another object of this invention to provide a chair control mechanism for an office chair that offers a greater degree of comfort to the user than previous chairs.

It is a still further object of this invention to provided a chair control mechanism for a chair that is easily adapted to a variety of office chairs, is attractive in appearance, is reliable in its operation and is capable of being produced at a reasonable cost.

It has been discovered that the foregoing objects can be attained by a chair control mechanism for a pedestal base office type chair comprising a chair control housing mounted on a pedestal chair base and pivotally supporting a chair seat support member. The chair seat support member has a front flange portion provided with a plurality of the laterally spaced tabs. A laterally movable front stop member is retained within the chair control housing adjacent the front flange portion of the chair seat support member. The laterally movable front stop member has an upper set of laterally spaced bearing surfaces separated by a lower set of laterally spaced bearing surfaces and is equipped with means to laterally move the front stop member whereby either the upper set or the lower set of laterally spaced bearing surfaces of the movable front stop member are laterally aligned and in contact with the laterally spaced tabs of the front flange portion. The control mechanism also includes means to lock the laterally spaced tabs of the front flange portion against either the upper set or the lower set of laterally spaced bearing surfaces of the front stop member and prevent further pivotal movement of the chair seat support member about the chair control housing.

DESCRIPTION OF THE PREFERRED EMBODIMENTS

Figure 1:
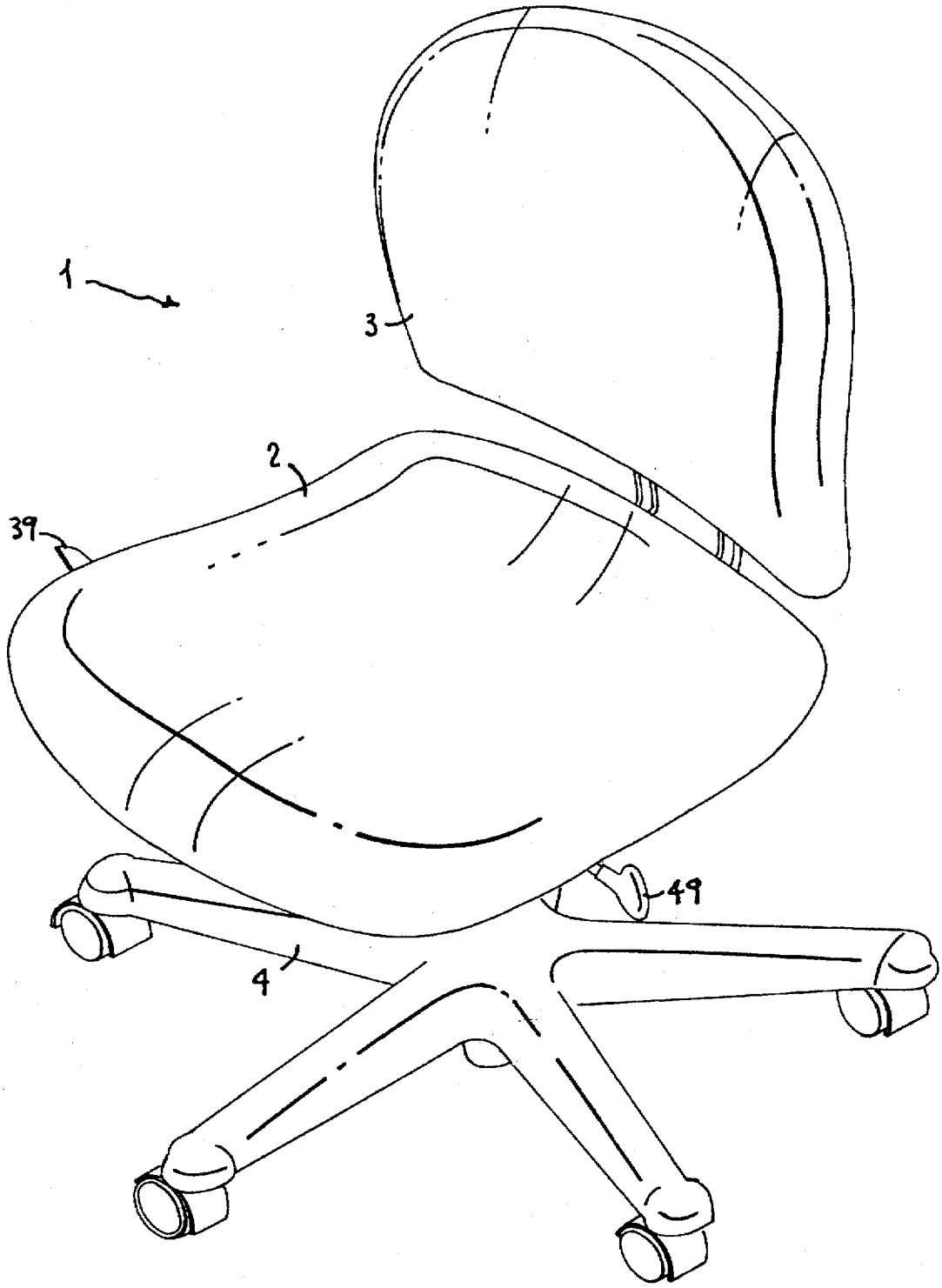
FIG. 1 is an isometric view of a two piece office chair having the chair control mechanism of this invention.
Figure 2:
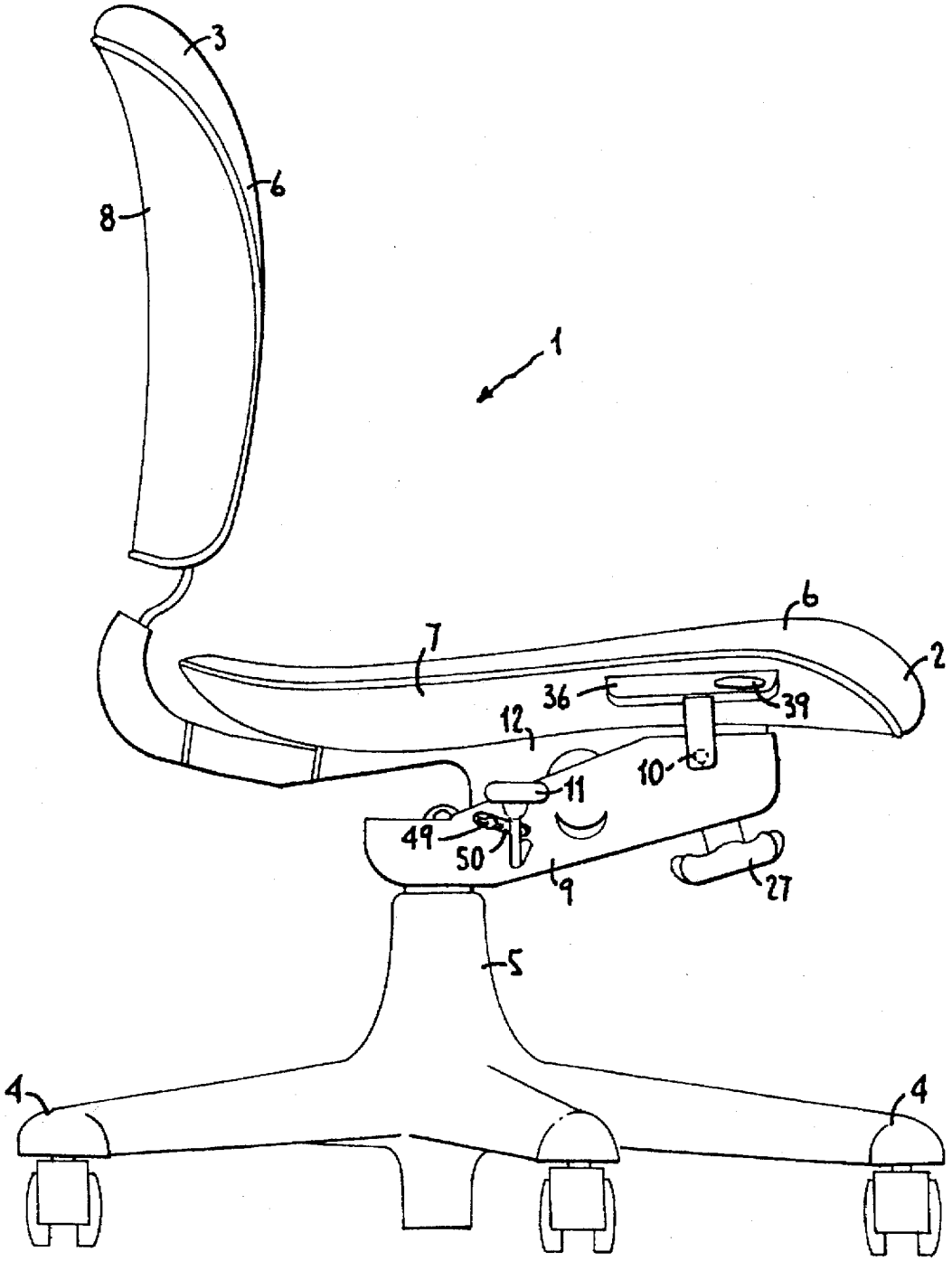
FIG. 2 is a side view of the two piece office chair illustrated in FIG. 1.

FIGS. 1 and 2 are an isometric view and a side view, respectively, of a two piece office chair 1 having the chair control mechanism of this invention. The chair 1 is comprised of a chair seat 2 and a separate but connected chair back 3 supported on a pedestal chair base 4 by a support column 5 that contains a chair seat height adjusting mechanism (not shown) that may be a pneumatic cylinder controlled by a chair seat height adjustment lever 11 extending out one side of a chair control housing 9.

In describing the preferred embodiments of the mechanism of this invention, the terms "front" and "rear" will refer to the "front" of the chair seat 2 which normally supports the lower thighs and knees of the seated user. The term "lateral" will refer to a cross section extending across the chair seat 2 between the two sides of the chair seat 2.

Both the chair seat 2 and the chair back 3 are comprised of inner liners and inner cushions (not shown) covered with a fabric or other upholstery material 6 and mounted on injection molded plastic outer shells 7 and 8. The chair seat 2 of this embodiment, is attached to a chair seat support member 12 that in turn is pivotally attached to the chair control housing 9 supported on the support column 5. The chair control housing 9 contains springs, linkage and controls, described below, that permit the chair seat 2 and the chair seat support member 12 to pivot and tilt about pivot points 10 and to be locked into desired predetermined angular positions with respect to the floor and the user's worksurface.

Figure 3:
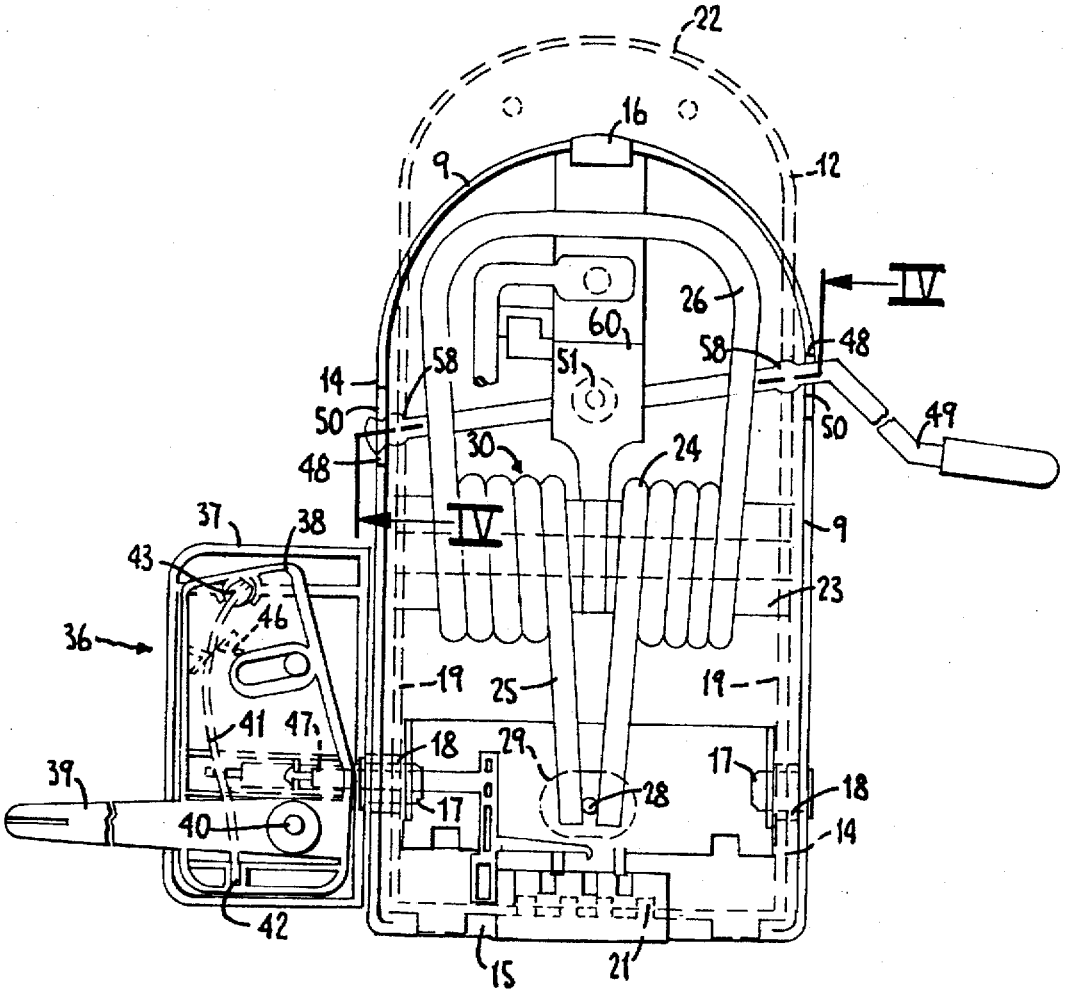
FIG. 3 is a top view of a preferred embodiment of the chair control mechanism of this invention.
Figure 4:
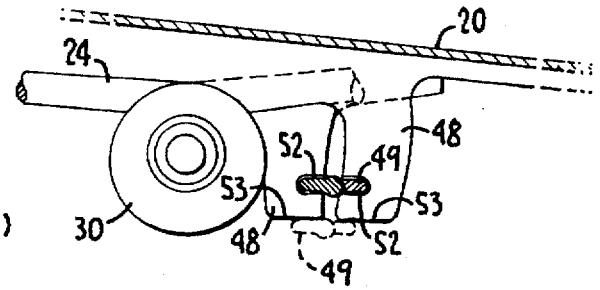
FIG. 4 is a sectional view of the chair control mechanism of this invention taken along section lines IV—IV shown in FIG. 3.

FIGS. 3 and 4 are a top view and a sectional view, respectively of a preferred embodiment of the chair control mechanism of this invention. As shown in FIGS. 3 and 4, the chair control housing 9 is made of metal, either cast or stamped, and is comprised essentially of a bottom portion 13, a pair of upstanding parallel sidewall portions 14 and a short upstanding front wall 15 and back wall 16. The upstanding parallel sidewall portions 14 are each provided, at the pivot points 10, to receive unique hollow plastic pivot pins 17 which pass through the sidewall portions 14 and through plastic bushings 18 fitted into aligned openings in parallel downwardly facing parallel side portions 19 of the chair seat support member 12. The pivot pins 17 provide the pivot points 10 about which the chair seat support member 12 pivots relative to the chair control housing 9 and provides for the tilting and angular adjustment of the chair seat 2.

As shown in FIGS. 3 and 4, the chair seat support member 12 is comprised essentially of an upper flat metal plate portion 20 and is attached to the underside of the padded and upholstered chair seat 2 and the plastic outer shell 7 for the chair seat 2. In this embodiment, the chair seat support member 12 is provided with a front flange 21 and a rear flange 22, which stiffen the chair support member 12 and also serve as front and rear tilt stops.

Mounted horizontally between the sidewalls 14 of the chair control housing 9 is a spring support guide member 23. Surrounding the spring support sleeve 23 is a double coil torsion spring 30 comprised of double spring coils 24, a pair of forward extending legs 25 and a rearwardly extending lever arm 26 that is connected to both spring coils 24.

As shown in FIGS. 2 and 4, a spring 30 tension adjustment knob 27 is attached to a tension adjustment screw 28 that passes through an opening in the front of the bottom portion 13 of the chair control housing 9 and up between the forward extending legs 25 of the double torsion spring 30. A threaded nut assembly 29 is fastened to the leading end of the tension adjustment screw 28 on top of the forward extending legs 25 of the spring 30. Turning the tension adjustment knob 27 will increase or decrease the initial tension in the double torsion spring 30, as desired.

Figure 7:
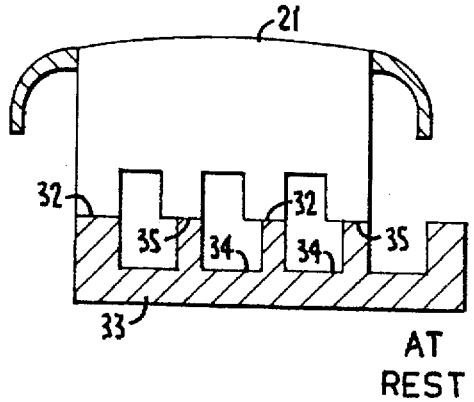
FIGS. 7 and 8 are front views of the forward tilt stop assembly with the seat in the "at rest" position and in the forward tilt position, respectively.
Figure 8:
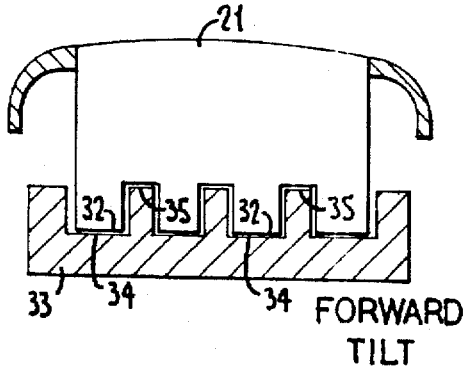
Figure 9:
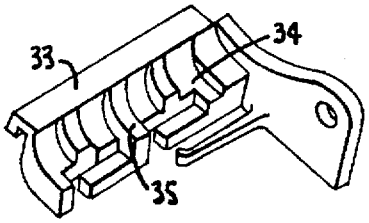
FIG. 9 is an isometric view of the forward tilt stop member.

As illustrated in FIGS. 4, 7 and 8, the front flange 21 of the chair seat support member 12 is curved downwardly and is provided with a plurality of laterally spaced tabs 32. A laterally movable front stop member 33 is retained within guides attached to the chair control housing 9 adjacent and immediately beneath the front flange 21 and the tabs 32 formed in the chair seat support member 12. The front stop member 32 has an upper set of laterally spaced bearing surfaces 34 separated by a lower set of laterally spaced bearing surfaces 35. The upper set of laterally spaced bearing surfaces 34 are at a higher elevation than the lower set of laterally spaced bearing surfaces 35, which elevation will determine the degree of forward tilt for the chair seat 2 from the neutral "at rest" position using this invention.

Figure 5:
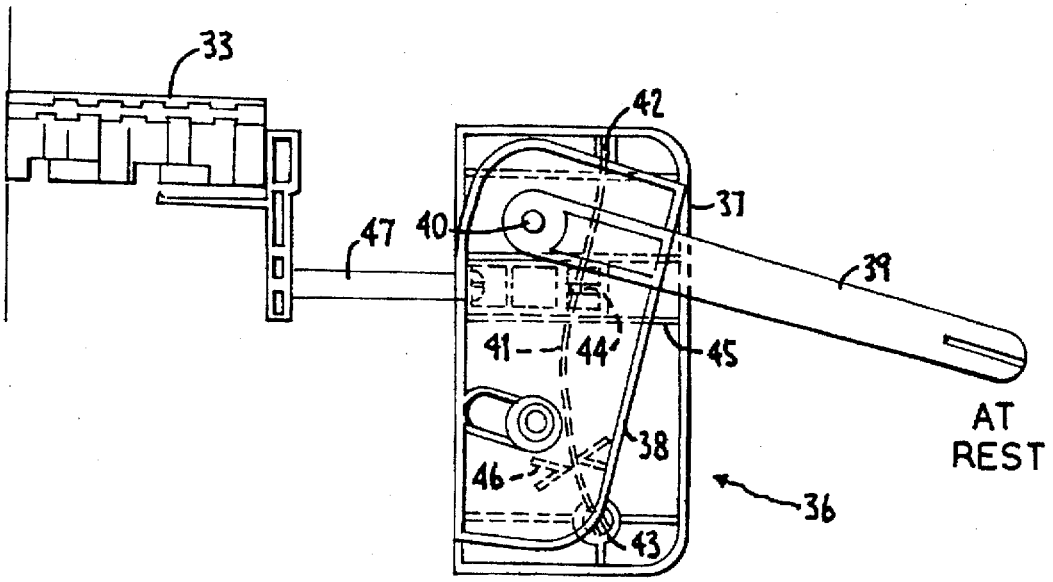
FIGS. 5 and 6 are top views of the forward tilt control mechanism of this invention illustrating the mechanism with the seat in "at rest" position and in the forward tilt position, respectively.
Figure 6:
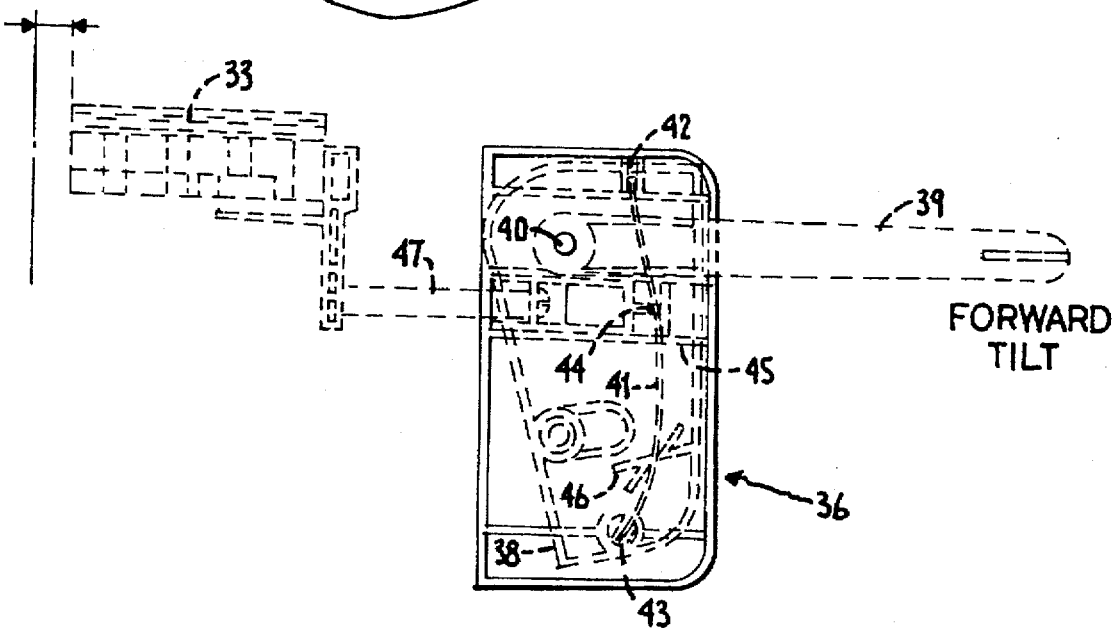

The laterally movable front stop member 33 is able to be moved laterally within its guides by a tilt position selector lever assembly 36 mounted to the underside of the chair seat 2 adjacent to one side of the chair seat support member 12. As best illustrated in FIGS. 3, 5 and 6, the tilt position selector lever assembly 36 is comprised of an outer housing 37 and an inner tilt position selector 38. The inner tilt position selector 38 is integral with or attached to one end of a lever 39 and is able to pivot about pivot pin 40 attached to the outer housing 37. A thin elongated leaf spring 41 has one end attached to a fixed connection 42 within the outer housing 37 and the other end attached to a rotatable connection 43 within the outer housing 37 and fits within a slot of a slide carrier member 44 that slides laterally between guides 45 formed in the outer housing 37 and is secured to one end of a cylindrical connecting link 47 that extends through one of the hollow plastic pivot pins 17. The spring 41 also fits between a pair of V-shaped retainers 46 in the inner housing 38. The tilt selector lever assembly 36 and its components are preferably made of a reinforced injection molded plastic but could also be made of metal.

As best illustrated in FIGS. 5 and 6, movement by the user of the lever 39 will cause the connected selector 38 to pivot about the pivot pin 40 and will also cause the reversal of the the curvature of the leaf spring 41 by pressure from the V-shaped retainers 46. The reverse movement of the leaf spring 41 causes the slotted slide carrier member to move laterally and move the connecting link 47 laterally resulting in a short (about ⅜ inch) lateral movement of the front stop member 33. As illustrated in FIGS. 7 and 8, the short lateral movement of the front stop member 38 will move either the lower set of bearing surfaces 34 or the upper set of bearing surfaces 35 of the front stop member 38 into lateral alignment with the tabs 32 of the front flange 21 of the chair seat support member 12. When the tabs 32 rest upon and contact the lower set of bearing surfaces 34, the chair seat 2 will be in a forward tilt position and when the tabs 32 rest upon and contact the upper set of bearing surfaces 35, the chair seat 2 will be in the neutral "at rest" position, as best illustrated in FIGS. 7 and 8.

An important feature of the tilt selector lever assembly 36 as described above, is that the lateral movement of the connecting link 47 by operating the lever 39, which movement changes the lateral position of the front stop member 33, is done through axis of the hollow pivot pin 17, which also being the pivot point 10 for the chair tilt control, does not change in position as the chair is tilted to various positions. By having the lateral movement conducted through the pivot point 10, the selector lever assembly 36 is more efficient and less complex to construct and operate.

Figure 10:
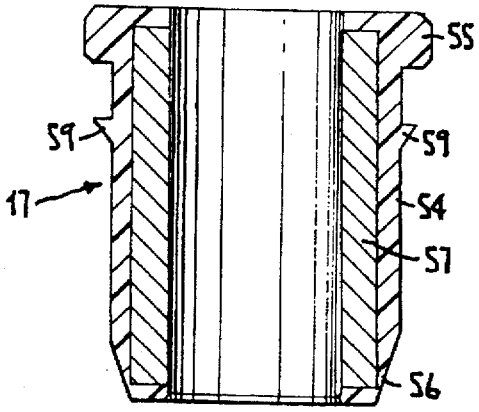
FIG. 10 is an enlarged sectional view of the unique hollow pivot pin used in the preferred embodiment of the chair control mechanism of this invention.

The hollow plastic pivot pin 17 used in this embodiment, is illustrated in FIG. 10 and is comprised of a cylindrical tubular plastic member 54 having a circular flange 55 at one end and a chamfer 56 at the other end and is provided with locking snap tabs 59 which snap lock the outer periphery of the pin 17 into an opening. A cylindrical tubular metal sleeve 57 is secured within and against the inside diametral surface of the tubular plastic member 54 by portions of the each end of the plastic tubular member 54 which extend over the ends of the tubular metal sleeve 57, as illustrated in FIG. 10. The tubular metal sleeve 57 not only acts as a retainer and bearing surface for the sliding connecting link 47, but also adds to the strength of the pivot pins 17 which support the weight of the chair seat 2 and the user.

The tilt position selected by the user using the tilt selector lever assembly 36 as described above, can be locked into place by a locking arrangement illustrated best by FIGS. 3 and 4. The chair seat support member 12 has a pair of spaced flanges 48 extending substantially downwardly from the underside of the chair seat support member 12. A locking lever 49 extends from outside of the chair control housing 9 through elongated slots 50 in each of the vertical sidewalls 14 of the chair control housing 9. The locking lever 49 in this embodiment is a cylindrical rod fitted with a handle and having short portions 58 elongated or flattened in cross section where the locking lever 49 passes through the elongated slots 50 in each of the vertical sidewalls 14 of the chair control housing 9. The slots are preferably shaped to accomaodate the cross section of the locking lever 49 and to also provide a positive "snap" action for easy user identificaion of the locking function. The locking lever 49 is pivotable about a pivot point 51 centrally located between the vertical sidewalls 14 of the chair control housing 9. A short pivotal movement of the locking lever 49 by the user will cause the lever rod 49 to engage either a slot 52 in each of the spaced flanges 48 or engage the bottom end 53 of a each of the spaced flanges 48 and thereby prevent any further pivotal movement of the chair seat support member 12 about pivot point 10 until the locking lever 49 is moved by the user to out of contact with the slots 52 or bottom ends 53. When the locking lever 49 is in the slots 52, the chair seat 2 will be locked in the neutral "at rest" position described above and when the locking lever is against the bottom ends 53 of the flanges 48, the chair seat will be locked in the forward tilt position described above. A retainer member 60 is used to retain the locking lever 49 within the chair control housing and to keep it centered on the top of the pivot point 51.

With the chair tilt control mechanism of this invention, the chair user is able using two accessible and convenient levers to quickly and easily move the chair seat from a neutral "at rest" position to a forward tilt position and vice versa and to lock the chair in the tilt position selected.

While we have described this invention by illustrating and describing the preferred embodiment of it, we have done so by way of example, and are not to be limited thereby as there are modifications and adaptions of this embodiment that could be made within the scope of this invention.

We claim:

1. A chair tilt control mechanism for a pedestal base chair comprising:

a chair control housing mounted on a pedestal chair base and supporting a chair seat support member;

a laterally movable front stop member retained within the chair control housing;

a lever mounted to an underside of a chair seat for laterally moving the front stop member;

a connecting link member for laterally moving the front stop member, the connecting link member extending through a bore of one of a pair of hollow pivot pins so that the lateral movement of the front stop member by the connecting link member is conducted through the hollow pivot pin;

each of the hollow pivot pins pivotally connecting the chair control housing to the chair seat support member and comprising a cylindrical tubular plastic member having a circular flange at one end and a pair of pointed, locking snap tabs located on the outer peripheral surface of the tubular plastic member for snap locking the outer periphery of each pin to the chair control housing and chair seat support member.

2. The chair tilt control mechanism according to claim 1 wherein each of the hollow plastic pivot pins includes an opposite end which is camphered.

3. The chair tilt control mechanism according to claim 2 wherein each of the pins further includes a cylindrical tubular metal sleeve secured within and against the diametral surface of the tubular plastic member for retaining and providing a bearing surface for the connecting link member and for strengthening each of the pivot pins.

4. The chair tilt control mechanism according to claim 13 wherein the tubular metal sleeve is retained by portions of each end of the plastic tubular member, the portions extending over ends of the tubular metal sleeve.

* * * * *